United States Patent [19]

Belica

[11] Patent Number: 4,754,248

[45] Date of Patent: Jun. 28, 1988

[54] DEFLECTION YOKE HAVING WINDING RETAINING NOTCHES

[76] Inventor: Roddy Belica, 1221 N. Humphrey Ave., Oak Park, Ill. 60302

[21] Appl. No.: 941,570

[22] Filed: Dec. 12, 1986

Related U.S. Application Data

[63] Continuation of Ser. No. 585,849, Mar. 2, 1984, abandoned.

[51] Int. Cl.[4] ..... H01F 7/00

[52] U.S. Cl. ..... 335/210; 335/213; 242/4 B; 242/4 C

[58] Field of Search ..... 335/210, 213; 242/4 B, 242/4 C, 206, 209, 211

[56] References Cited

U.S. PATENT DOCUMENTS

| | | | |
|---|---|---|---|
| 3,299,379 | 1/1967 | Torsch | 335/213 |
| 3,757,224 | 9/1973 | Fedorko et al. | 335/213 |
| 3,766,641 | 10/1973 | Metzler et al. | 335/213 |
| 3,947,793 | 3/1976 | Thompson | 335/210 |
| 4,175,261 | 11/1979 | Sawada | 335/210 |
| 4,181,908 | 1/1980 | Yoshikawa | 335/210 |
| 4,243,965 | 1/1981 | Yoshikawa | 335/213 |
| 4,246,560 | 1/1981 | Shimizu et al. | 335/213 X |
| 4,277,767 | 7/1981 | Ura | 335/210 |
| 4,359,705 | 11/1982 | Bohn et al. | 335/213 |
| 4,378,544 | 3/1983 | Yabase et al. | 335/210 |

*Primary Examiner*—George Harris

*Attorney, Agent, or Firm*—Lockwood, Alex, Fitzgibbon & Cummings

[57] ABSTRACT

A deflection yoke for deflecting an electron beam generated in a cathode-ray tube includes a frusto-conical ferrite core. A pair of windings, each comprising a plurality of turns toroidally wound on the core, produce a magnetic field for deflecting the electron beam when current is passed through the windings. The ferrite core includes a plurality of notches formed in its edge which receive respective ones of the windings to accurately fix the location of the windings with respect to the core. Providing notches directly in the core avoids the need for additional external members for positioning the windings, and improves performance by reducing ringing.

22 Claims, 3 Drawing Sheets

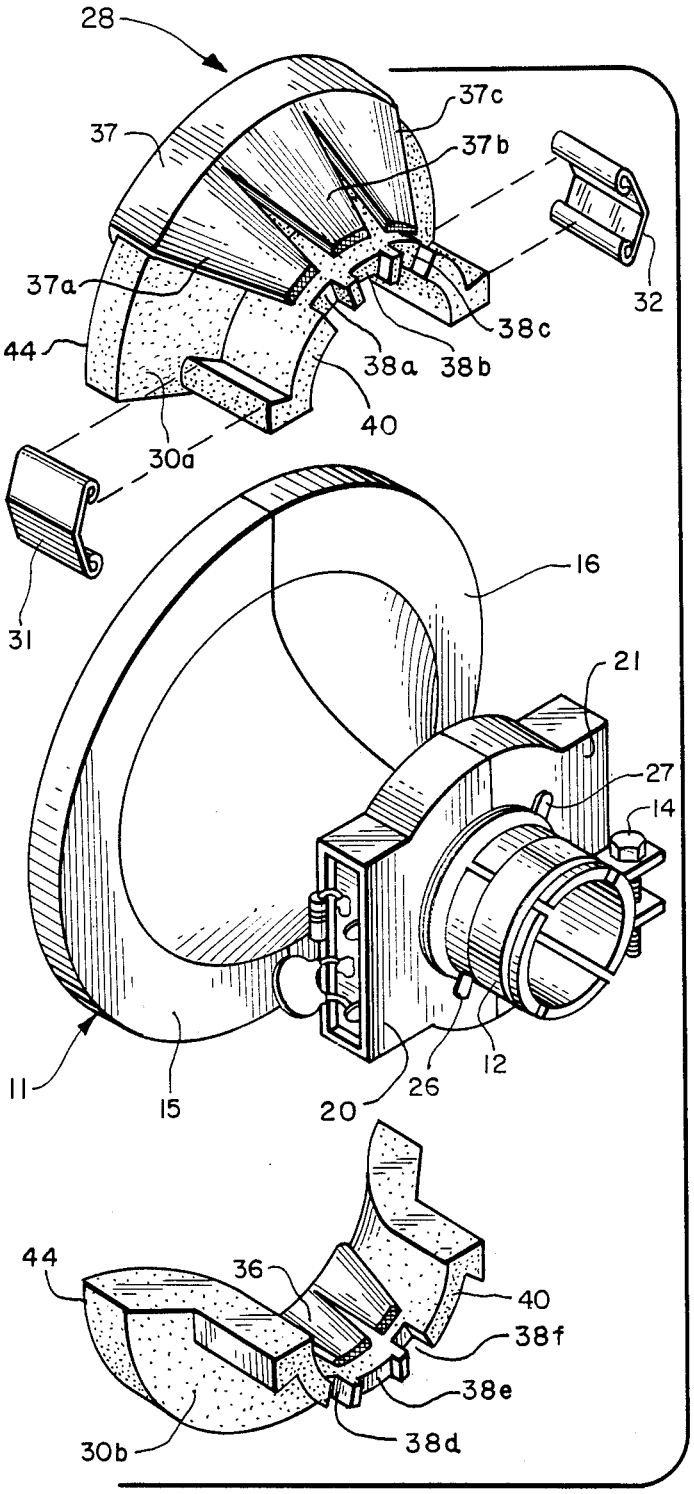
FIG. 4
FIG. 5
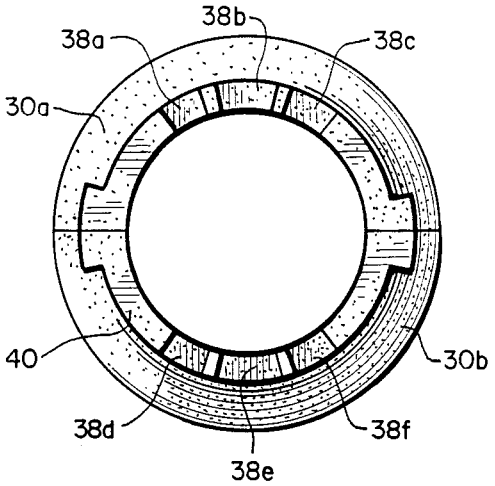
FIG. 6
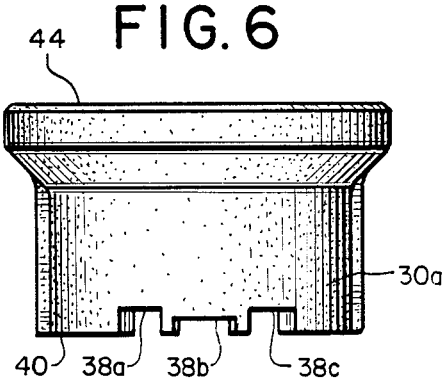
FIG. 7
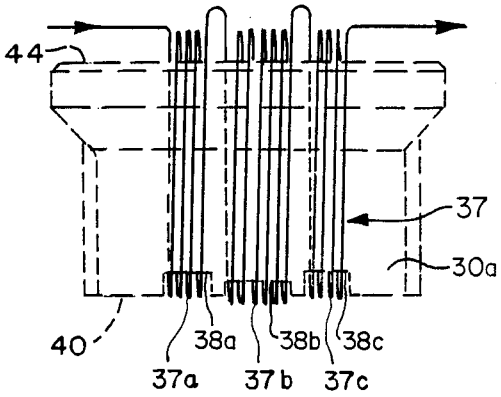

DEFLECTION YOKE HAVING WINDING RETAINING NOTCHES

This application is a continuation of application Ser. No. 585,849, filed Mar. 2, 1984, now abandoned.

BACKGROUND OF THE INVENTION

This invention relates generally to deflection yokes, and in particular to deflection yokes for use with monochrome or color television receivers wherein vertical deflection windings are toroidally wound on a ferrite core.

In conventional monochrome and color television receivers, a cathode-ray tube (CRT) is provided with a deflection yoke assembly for deflecting electron beams generated within the CRT to produce a display raster. In the case of color television receivers, the deflection yoke performs the additional function of converging the beams provided by three separate electron guns. Typically, deflection yoke assemblies include a frusto-conical ferrite core dimensioned to surround the relatively narrow neck portion of the CRT where it joins the flared portion of the tube envelope. Frequently, the deflection yoke includes a pair of diametrically opposed toroidally wound windings on the ferrite core for causing vertical deflection of electron beams, while a pair of saddle-shaped windings, disposed between the interior surface of the core and the external surface of the envelope, provide horizontal deflection of the beam. As the quality of the display is greatly affected by the configuration and location of the deflection windings, much effort has been expended in developing winding distributions which provide displays of superior quality.

Since the path distances travelled by individual electrons of the electron beam vary according to the location on the screen to which the beam is directed, use of uniform magnetic deflection fields would result in a distorted raster. Accordingly, non-uniform fields are used to obtain a non-distorted raster. Such non-uniform fields are produced by altering the shape of the deflection windings as well as the distribution of turns within individual windings. Cosine windings, wherein the turns density varies according to the cosine of an angle, constitute one form of distribution frequently used. Other winding distributions, which may involve cross-overs of individual windings, may also be used.

Once an acceptable winding distribution has been identified, it is necessary for a deflection yoke manufacturer to develop a method for accurately and economically reproducing the desired distribution over a large quantity of cores. One technique developed for this purpose is to attach plastic rings having notches, ridges, or pins to either or both edges of the ferrite core. The windings overlap the rings, which serve to maintain the position of the windings relative to the core. The technique is attractive, particularly where the winding distribution is complex since it is relatively easy to accurately mold a great number of precisely dimensioned notches in the plastic rings. However, the additional manufacturing steps required raise manufacturing costs.

The present invention overcomes the disadvantages of prior techniques by directly providing at selected locations in the ferrite core a number of notches of preselected depth and width. In winding the deflection windings of the yoke, wire is placed on the core so that each notch is filled before winding commences on the next adjacent notch. Thus, each turn is substantially parallel with the others and wire cross-overs are eliminated. The technique of forming the notches directly in the core avoids the economic disadvantage associated with installing plastic rings, and the relatively large dimension of each notch avoids the difficulty associated with accurately forming a large number of small, precisely dimensioned notches directly in the core, since dimensional changes resulting from shrinkage of the core during firing after casting are less significant with the relatively larger notches.

The present invention has the further advantage that less time is required to form the windings since the position of each turn within a notch is not as critical as with notches of lesser width. Furthermore, the accurate positioning of the windings by reason of their being disposed in accurately positioned notches improves linearity in the completed yoke, while lower inter-winding capacitance, resulting from the elimination of wire cross-overs, reduces distortion in the display such as that caused by "ringing". Additionally, providing notches directly in the ferrite core allows the linear dimension of the core to be increased without requiring a corresponding increase in the length of the vertical windings placed thereon. The effect of this is that sensitivity of the horizontal windings may be increased by extending the core along those portions between the vertical windings without simultaneously increasing the physical dimensions, and hence the cost, of the vertical windings.

Accordingly, it is a general object of the present invention to provide a new and improved deflection yoke for use with cathode-ray tubes.

It is a further object of the present invention to provide a deflection yoke which is more economical to manufacture and more accurate and repeatabe in performance.

SUMMARY OF THE INVENTION

A deflection yoke for use with cathode-ray tubes of the type in which one or more electron beams generated therein are deflected, includes a one-piece magnetic core member having at least one notch therein. At least one electrically conductive winding, toroidally wound on the core member, produces a magnetic field for deflecting the beam. Each turn of the winding extends through the notch which holds the winding in a predetermined position relative to the magnetic core member to improve performance and reduce manufacturing costs.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 4 an exploded perspective view, partially in section, of the deflection yoke shown in FIG. showing a notched ferrite core constructed in accordance with the present invention;

FIG. 5 is a rear elevational view of the notched ferrite core shown in FIGS. 1–4, showing the notched rear surface thereof;

FIG. 6 is a side elevational view of the core shown in FIG. 5, further illustrating the notched rear surface thereof; FIG. 7 is a schematic representation of a horizontal deflection winding disposed on the core shown in FIG. 6.

DESCRIPTION OF THE PREFERRED EMBODIMENT

Figure 1:
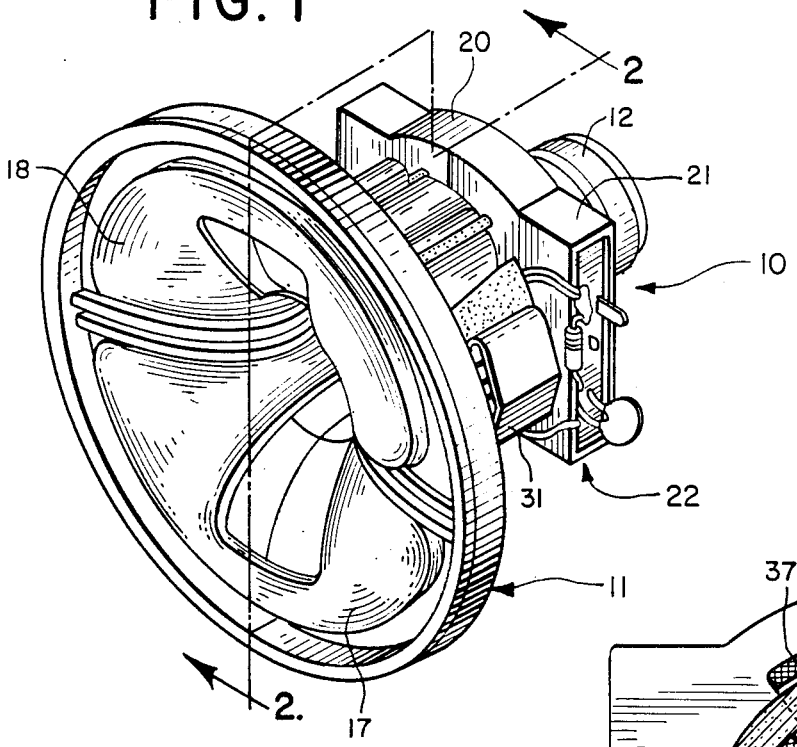
FIG. 1 is a perspective view of a deflection yoke incorporating a ferrite core constructed in accordance with the present invention.

Referring to the drawings, and in particular to FIGS. 1–4, a deflection yoke 10 for use with a cathode-ray tube (CRT) such as may be utilized in a conventional monochrome television receiver or video monitor is illustrated. The deflection yoke includes a generally funnel-shaped frame 11 fashioned from molded plastic or similar insulating non-magnetic material and dimensioned to encircle the neck of a CRT (not shown) where it joins the flared portion of the tube envelope. In use, the deflection yoke is placed over the neck of the CRT with its relatively larger diameter end toward the display screen. The yoke is held in position by means of a compression ring 12 and bolt 14 (FIG. 4) which compress the slotted narrow end of frame 11 around the CRT neck. In accordance with conventional practice, the frame is fashioned in the form of two mirror-image members 15 and 16 joined to each other by means of tabs and recesses provided along their mating edge.

Figure 2:
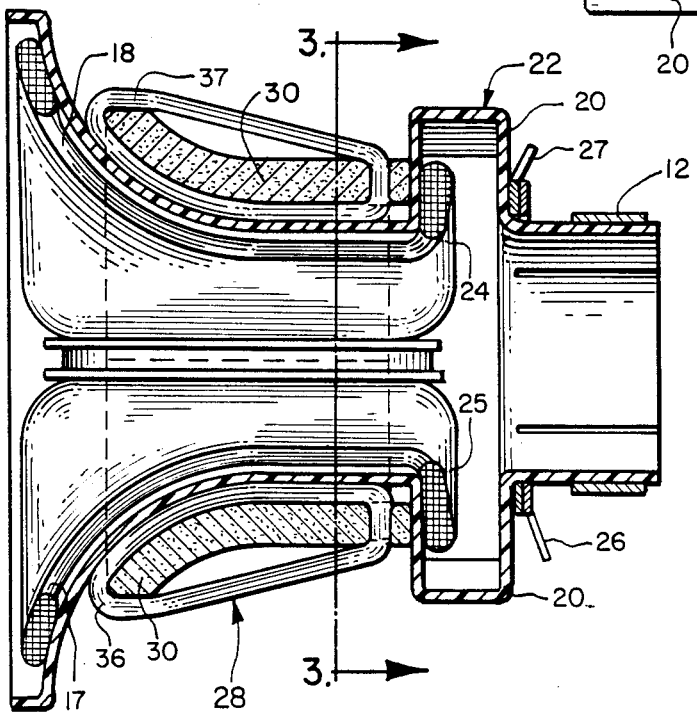
FIG. 2 is a cross-sectional view of the deflection yoke shown in FIG. 1 taken along line 2—2 thereof.

In order to horizontally deflect electron beams generated within the neck of the CRT, the deflection yoke, in a manner well known to the art, is provided with a pair of opposed saddle-shaped deflection windings 17 and 18 (FIG. 2). In order to accommodate the arcuate rearward edge of each saddle winding, the frame members may include enlarged portions 20 and 21 which together form a housing 22 into which the rearward edges 24 and 25 of the saddle coils extend, as illustrated in FIG. 2. Immediately to the rear of housing 22 are a pair of adjustable centering rings 26 and 27 which, in a manner well known to the art, provide adjustment of beam position.

Figure 3:
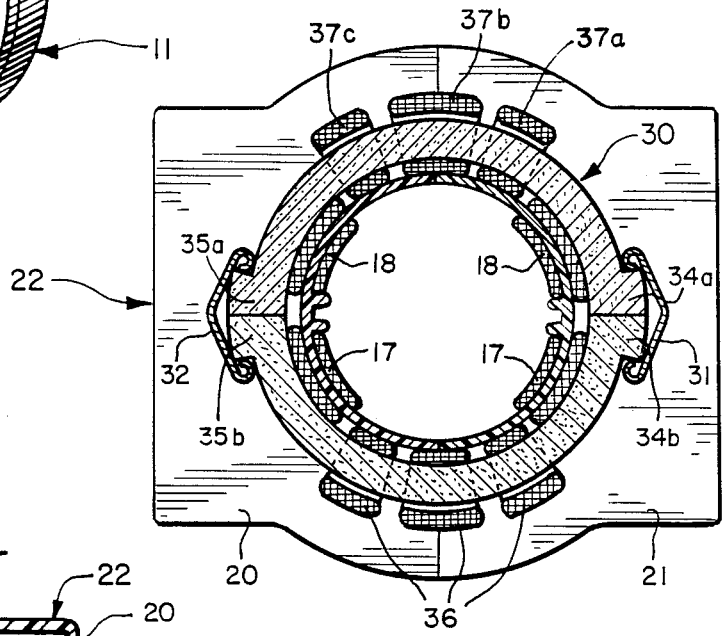
FIG. 3 is a cross-sectional view of the deflection yoke shown in FIG. 2 taken along line 3—3 thereof.

In order to provide vertical deflection of the electron beam, deflection yoke 10 includes a vertical deflection winding assembly indicated generally by reference numeral 28 and illustrated most clearly in FIGS. 2–4. Referring to these figures, the vertical deflection winding assembly includes a frusto-conical ferrite core 30 coaxially aligned with frame 11 along the outer surface thereof. Core 30 is fashioned from a powdered ferrite material which is press-molded or slip-cast in a known manner to form a casting which is then fired in a kiln to form a rigid, mechanically rugged casting. During the firing process, core 30 may shrink as much as 25%. Accordingly, it is necessary to cast the core somewhat oversize in order to achieve the desired dimensions after firing.

In one embodiment, the deflection yoke includes a single one-piece core member which completely encircles the neck of the CRT. Alternatively, the yoke may employ a pair of core members, each encircling one half of the CRT neck, which cooperate to fully encircle the neck.

In order to facilitate installation of core 30 on frame 11, the core may be split along a plane passing through its linear axis to form two halves 30*a* and 30*b*, as shown in FIG. 4. A pair of spring clips 31 and 32 engage respective pairs of integrally formed tabs 34*a*, 34*b* and 35*a*, 35*b* to clamp core halves 30*a* and 30*b* firmly together. The area where each tab joins the body of the core may be slightly undercut as shown to form a notch for more positive engagement of the spring clips.

In accordance with conventional practice, the electron beam generated within the CRT is vertically deflected by means of a magnetic field established by passing current through appropriate windings on the ferrite core. In the deflection yoke illustrated, such windings take the form of two windings, 36 and 37, toroidally wound diametrically opposite one another, as shown in FIGS. 2 and 4. In order to accurately maintain the desired position of the vertical deflection windings, core 30, in accordance with the present invention, is provided with a plurality of notches 38*a*–38*f* along its rear edge 40, it being understood that the rear edge is that edge facing away from the CRT screen.

Referring now to FIGS. 5–7, the notches of the particular embodiment illustrated are seen to be arranged in two diametrically opposed groups, each group comprising three notches. While any number of notches can be provided, it has been found practically that a total of six notches gives best performance in monochrome receivers, while a total of eight notches, arranged in two groups of four each, gives best performance in color receivers. As shown in FIGS. 5 and 6, the notches are generally rectangular in form, and have a flat bottom which lies in a plane perpendicular to the axis of the core, and side walls which are perpendicular to the bottom and are aligned generally radially (radii r in FIG. 5) toward the center of the core for optimum control of winding location. As shown in FIG. 6, the outer notches 38*a*, 38*b*, 38*d* and 38*f* are preferably of greater depth than the middle notches 38*b* and 38*e*, and the widths of the outer notches are preferably less than the widths of the middle notches. Preferably, the notches are dimensioned so as to be of equal volume relative to the plane established by the rear edge of the core.

Vertical deflection windings 36 and 37 each comprise a plurality of serially connected windings, each of which comprises a plurality of turns wound toroidally around ferrite core 30. Each winding may or may not include sufficient turns to completely fill one of the notches 38*a*–38*f*, in accordance with the yoke inductance required. In forming the windings, each notch, beginning with one of the outer notches, is completely filled with turns before winding is commenced in the next adjacent notch. This is in contrast with conventional practice wherein turns are distributed over the core in a predetermined distribution, such as the conventional cosine distribution winding familiar to those skilled in the art. To avoid damaging the windings, the edges of the core over which the windings pass may be rounded or formed with a radius thereby eliminating sharp edges.

As shown in FIG. 7, vertical deflection winding 37 may be represented as a serial combination of three individual winding portions 37*a*–37*c* arranged in core notches 38*a*–38*c*, respectively. In practice, the winding portions preferably merge at their leading edges, as shown in FIG. 4, to form a substantially unbroken mass of turns along the forward edge 44 of the core. Winding 36 is similarly formed by multiple winding portions and may be series connected or parallel connected with winding 37 as required by the particular television receiver circuit design.

An additional feature of the invention is that by providing notches directly in the core, the total core length may be increased to increase the sensitivity of the horizontal windings without requiring a similar increase in the dimension, and hence cost, of the vertical deflection windings. This can be done by extending those portions of the core between the notches.

Figure 8A:
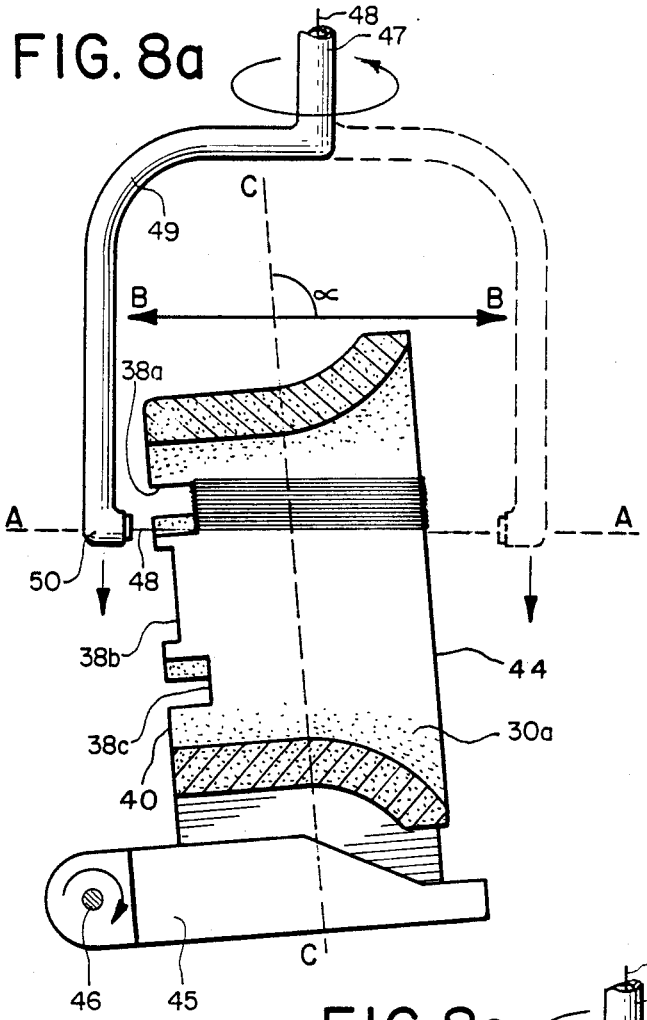
FIGS. 8*a*–8*c* illustrate the use of automatic coil winding machinery for winding a vertical deflection coil on a notched ferrite core constructed in accordance with the present invention.
Figure 8B:
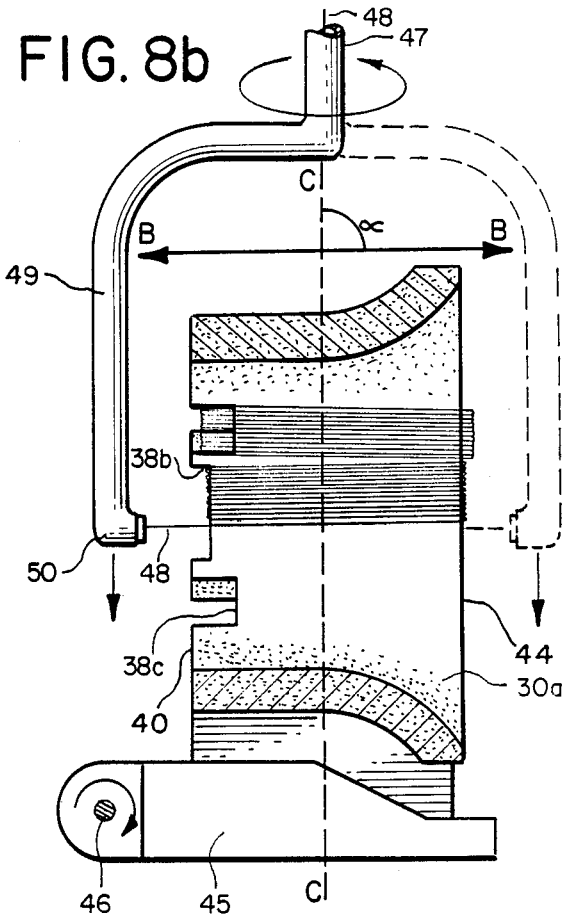
Figure 8C:
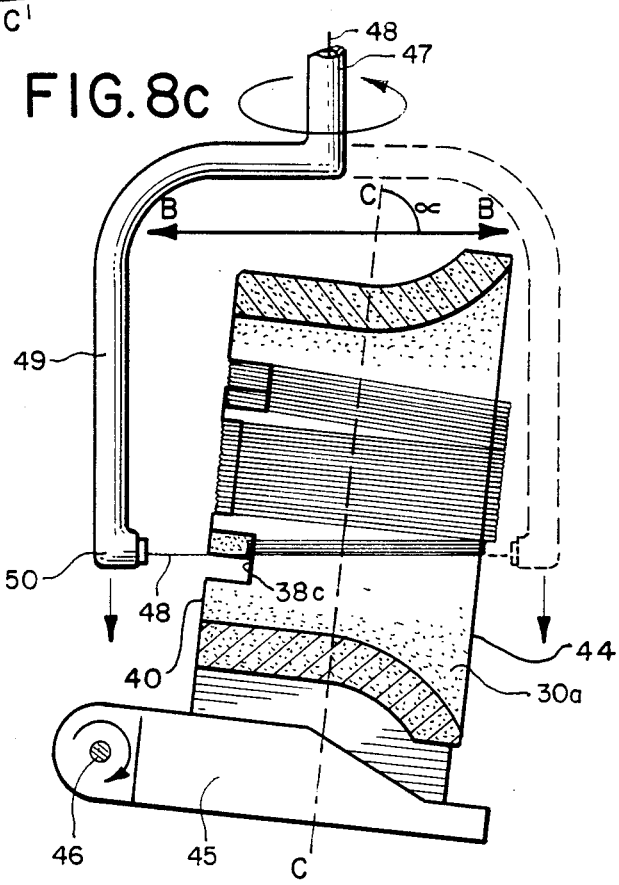

FIGS. 8*a*–8*c* illustrate a preferred method of constructing a deflection yoke having a notched core in accordance with the present invention utilizing an automatic coil winding machine to form the vertical deflection coil of the yoke. As shown in FIG. 8*a*, one core half 30*a* is tightly held by a clamp 45 attached to the machine and adapted for rotation around a pivot 46. Located above clamp 45 is a coil winding arm 49 mounted for rotation about a shaft 47 in the direction shown by the arrow. The lower portion of the coil winding arm is hook shaped and rotates around half core 30*a* in the vicinity of notches 38*a*–38*c* as shown by the solid and broken lines in FIGS. 8*a*–8*c*. Arm 49 is hollow to enable a wire 48 to be fed from a storage spool (not shown) through the arm to emerge at end 50, where it is wound onto the relatively stationary core half 30*a*. As arm 49 rotates, wire passing through end 50 is continuously coiled onto the core.

Referring to FIG. 8*a*, it will be seen that each turn of the winding will lie in a plane parallel to the plane (line A—A) established by end 50 as it rotates around the core. A line B—B, parallel to line A—A and hence to the winding plane, intersects line C—C, a line perpendicular to the axis of core 30, to form an angle $\alpha$. This angle represents the orientation of the winding plane relative to the core axis.

Referring further to FIG. 8*a*, at the beginning of the coil winding cycle, clamp 45 is rotated counter-clockwise as shown so that core 30 *a* is at an angle with respect to vertical ( more than 90°). The core is held in this position as windings are deposited on the core until they fill notch 38*a*. Since the core is angled with respect to vertical during the winding cycle, the windings so deposited will be deposited at an angle relative to the core as shown. Next, clamp 45 rotates clockwise to bring the core 30 to the substantially vertical position shown in FIG. 8*b* ( $\alpha$ equals 90°). Simultaneously, winding arm 49 travels vertically downward so that windings are deposited in notch 38*b* substantially perpendicular to the centerline C—C of the core. When notch 38*a* is filled, clamp 45 rotates further in a clockwise direction so that core 30*a* assumes the position shown in FIG. 8*c* ( $\alpha$ less than 90°). Then, winding arm 49 descends so that windings are next deposited in notch 38*c* until the notch is filled. Because core half 30 is not vertical during this operation, windings are deposited on the core at the angle $\alpha$ as shown in the figure. The effect of pivoting the clamp during the winding operation is that the coil thus formed subtends a substantially smaller total arc along the forward flarred edge 44 of the core than it does at the rear edge 40, thereby "pinching" the coil toward the forward edge of the core. It has been discovered that such "pinching" of the vertical deflection windings improves the CRT display by minimizing the "pin cushion" effect frequently encountered in such displays.

In using automatic coil winding machinery, maximum accuracy in the placement of windings on the core depends on accurately locating the core segment as it is clamped into the apparatus. The method of forming notches directly in the core provides a practical and simple method for locating a core in winding machinery by using one of the notches to position the core relative to an indexing member included in the winding apparatus. For example, the winding machinery could include a pivotally mounted bar dimensioned to be received in, for example, notch 38*b*. Alternately, the pivotally mounted bar could include a V-shaped blade projecting from its face which engages a similarly dimensioned V-shaped groove formed in a surface of the notch. Such a configuration is desirable since the V-shape edge and groove require accuracy only in their location and not in their dimension, which significantly simplifies the process of manufacturing cores having such grooves.

While the notches have been shown as being generally rectangular in cross-section, with a flat bottom and side walls which are generally perpendicular thereto, it will be appreciated that the cross-section may be modified, as for example, by changing the shape of the bottom to a downwardly curved surface, in particular applications.

While the invention has been shown as incorporated in a three segment vertical winding monochrome cathode-ray tube deflection yoke, it will be appreciated that the invention may be utilized in other types of yokes having a greater number of winding segments, including yokes intended for use with multi-gun color cathode-ray tubes.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A deflection yoke for use with a cathode-ray tube of the type in which an electron beam generated within the tube is magnetically deflected by a magnetic field of predetermined flux distribution, comprising:

a frusto-conical magnetic core member having a rear end of reduced diameter and a forward end of increased diameter;

a deflection winding comprising at least first and second end winding sections and at least one intermediate winding section toroidally wound on said core member and electrically interconnected for producing in response to an applied deflection signal a magnetic field for deflecting the electron beam; and wherein said magnetic core member includes in the rear edge thereof at least first and second end notches for receiving said first and second end winding sections, and an intermediate notch in said rear edge positioned circumferentially between said end notches for receiving said intermediate winding section, said first and second notches having a relatively greater depth than said intermediate notch, whereby said winding sections are maintained in a predetermined spaced-apart relationship, said intermediate winding section having a greater extent along the axis of said core member than said end winding sections.

2. A deflection yoke as defined in claim 12 having two diametrically opposed groups of at least three notches each, said winding comprising two groups of at least three serially connected windings each, each turn of respective ones of said windings extending through respective ones of said notches.

3. A deflection yoke as defined in claim 1 wherein said magnetic winding sections are connected in series circuit relationship.

4. A deflection yoke for use with the cathode-ray tube of a monochrome or color television receiver for providing vertical and horizontal magnetic deflection fields of predetermined flux distributions for deflecting the electron beam or beams generated in the relatively narrow neck portion thereof, comprising:

a frusto-conical ferrite core flared at its forward end and narrowed at its rear end and dimensioned to encircle the neck of the cathode-ray tube, said forward end being that end disposed toward the viewing screen of the cathode-ray tube, said ferrite core having a plurality of notches formed in diametrically opposed pairs in the rear edge thereof, said plurality of notches including a diametrically opposed first end pair, a diametrically opposed second end pair and at least one diametrically opposed intermediate pair positioned circumferentially between said first and second end pairs; and a pair of deflection windings toroidally wound in opposed relationship on said core, each of said windings including first and second end winding sections and an electrically interconnected intermediate winding section disposed therebetween, the winding sections of each deflection winding being disposed contiguously over the front edge of said core, and being received in respective ones of said notches on said rear edge, and said first and second pair of notches having relatively greater depth than said intermediate pair of notches whereby said winding sections are maintained in a predetermined spaced-apart relationship over said rear edge with said intermediate winding section having a greater extent along the axis of the core than said end winding sections, whereby said winding sections together provide a magnetic field having the predetermined vertical flux distribution in response to an applied deflection signal.

5. A deflection yoke as defined in claim 4 wherein said deflection windings subtend a first predetermined arc over said rear edge, and a second predetermined arc over said front edge, said second predetermined arc being less than said first predetermined arc.

6. A deflection yoke for use with the cathode-ray tube of a television receiver for providing a magnetic field of predetermined flux distribution for deflecting the electron beam or beams generated in the relatively narrow neck portion thereof, comprising:

a frusto-conical ferrite core flared at its forward end and narrowed at its rear end and dimensioned to encircle the neck of the cathode-ray tube, and having a plurality of notches formed in diametrically opposed pairs along the rear edge thereof, said plurality of notches including a diametrically opposed first end pair, a diametrically opposed second end pair and at least one diametrically opposed intermediate pair positioned circumferentially between said first and second end pairs;

a pair of vertical deflection windings toroidally wound in opposed relationship on said core, each of said windings including first and second end winding sections and an intermediate winding section serially connected therewith and disposed therebetween, the winding sections of each deflection winding being disposed contiguously over the front edge of said core and being received in respective ones of said notches on said rear edge, the notches receiving said end winding sections being deeper than the notches receiving said intermediate winding sections, such that said winding sections are maintained in a predetermined spaced-apart relationship over said rear edge with said intermediate winding sections being of greater extent along the axis of said core member than said end winding sections, whereby said windings provide a vertical deflection field having the predetermined flux distribution in response to an applied deflection signal; and a saddle winding in magnetic communication with said ferrite core for providing a horizontal deflection field for causing horizontal deflection of the electron beam.

7. A deflection yoke as defined in claim 4 wherein said magnetic winding sections are connected in series circuit relationship.

8. A method of manufacturing a deflection yoke comprising the steps of:

forming a frusto-conical ferrite core member having at least one notch formed in the rear edge thereof;

toroidally winding a plurality of turns onto said core member, each of said turns being received along a portion of its length in said notch;

holding said core member at an angle relative to the plane of said windings during said toroidal winding; and altering said angle during said winding whereby the angle formed between said core member and the plane of each of said windings varies according to said angle at which said core member is held.

9. A method of manufacturing a deflection yoke as defined in claim 8 wherein said angle is progressively altered so that said windings subtend a relatively greater arc at the rear edge of said core member than at the front edge of said core member.

10. A method of manufacturing a deflection yoke as defined in claim 8 further comprising the step of engaging at least one notch with an indexing member to initially accurately locate said core member prior to beginning said toroidal winding on said core.

11. A method of manufacturing a deflection yoke as defined in claim 8 wherein said core member comprises a continuous circular member for completely encircling the neck of a cathode-ray tube.

12. A method of manufacturing a deflection yoke as defined in claim 8 wherein said core member comprises a half core section adapted to encircle one half of the neck of a cathode-ray tube.

13. A method of manufacturing a deflection yoke as defined in claim 12 wherein said half core section includes in the rear edge thereof at least first and second end notches and an intermediate notch positioned circumferentially between said end notches, said first and second notches having a relatively greater depth than said intermediate notch and whereby the winding section received by said intermediate notch has a greater extent along the axis of said core member than the winding sections received by said end notches.

14. A method of manufacturing a deflection yoke as defined in claim 13 wherein said half core section includes at least two intermediate notches positioned circumferentially between said end notches.

15. A deflection yoke as defined in claim 6 wherein said deflection windings subtend a first predetermined arc over said rear edge and a second predetermined arc being less than said first predetermined arc.

16. A method of manufacturing a deflection yoke of the type having a frusto-conical ferrite core member, comprising the steps of:

forming at least one reflection winding section by toroidally winding a plurality of turns onto said core member, each of said turns being received along a portion of its length on the rear edge of the core member;

holding said core member at an angle relative to the plane of the windings during said toroidal winding; and altering said angle during said winding whereby the angle formed between said core member and the plane of each of said windings varies according to said angle at which said core member is held.

17. A method of manufacturing a deflection yoke as defined in claim 16 wherein said angle is progressively altered so that said windings subtend a relatively greater arc at the rear edge of said core member than at the front edge of said core member.

18. A method of manufacturing a deflection yoke as defined in claim 16 wherein said core member has one notch formed in the rear edge thereof in association with each said at least one deflection winding section and wherein said winding step further includes winding said turns whereby each said turn is received along a portion of its length in said notch.

19. A method of manufacturing a deflection yoke as defined in claim 16 wherein said core member comprises a continuous circular member for completely encircling the neck of a cathode-ray tube.

20. A method of manufacturing a deflection yoke as defined in claim 16 wherein said core member comprises a half core section adapted to encircle one half of the neck of a cathode-ray tube.

21. A method of manufacturing a deflection yoke as defined in claim 20 wherein said half core section includes in the rear edge thereof first and second end notches and an intermediate notch positioned circumferentially between said end notches, said first and second end notches having a relatively greater depth than said intermediate notch, and wherein said winding step further includes forming a winding section in association with each of said first and second end notches and said intermediate notch, each said winding section being received along a portion of its length in its respective notch, whereby the winding section received by said intermediate notch has a greater extent along the axis of said core member than the winding sections received by said end notches.

22. A method of manufacturing a deflection yoke as defined in claim 21 wherein said half core section includes in the rear section thereof at least two intermediate notches.

* * * * *